US006834944B2

(12) United States Patent
Wang et al.

(10) Patent No.: US 6,834,944 B2
(45) Date of Patent: Dec. 28, 2004

(54) INK SLOTS FOR PROVIDING INK TO UNILATERAL HEATERS

(75) Inventors: Chieh-Wen Wang, Hsinchu (TW); Leo Hu, Tai-Ping (TW); Yuan-Liang Lan, Chupei (TW); Eric G. Lean, Hsin-Chu (TW)

(73) Assignee: International United Technology Co., Ltd., Hsin-Chu (TW)

( * ) Notice: Subject to any disclaimer, the term of this patent is extended or adjusted under 35 U.S.C. 154(b) by 139 days.

(21) Appl. No.: 10/144,290

(22) Filed: May 13, 2002

(65) Prior Publication Data

US 2003/0174189 A1 Sep. 18, 2003

(30) Foreign Application Priority Data

Mar. 14, 2002 (TW) ..... 91203188

(51) Int. Cl.[7] ..... B41J 2/05; B41J 2/17
(52) U.S. Cl. ..... 347/65; 347/94
(58) Field of Search ..... 347/20, 63, 61, 347/65, 43, 93, 94, 56

(56) References Cited

U.S. PATENT DOCUMENTS 4,905,017 A * 2/1990 Sugitani et al. ..... 347/65
6,267,468 B1 * 7/2001 Torgerson et al. ..... 347/43

* cited by examiner

*Primary Examiner*—Juanita Stephens
(74) *Attorney, Agent, or Firm*—Thomas, Kayden, Horstemeyer & Risley

(57) ABSTRACT

An inkjet print head chip. The chip has a first column of firing chambers and a second column of firing chambers in which each firing chamber comprises a heater and an ink channel. A first ink slot is formed between the first column of firing chambers and the periphery of the chip, in which the first ink slot comprises a plurality of first ink sub-slots and each first ink sub-slot provides ink to part of heaters in the first column of firing chambers. A second ink slot is formed between the second column of firing chambers and the periphery of the chip to provide ink to the heaters in the second column of firing chambers. A dry film is patterned on the entire surface of the chip to separate the first ink sub-slots.

22 Claims, 11 Drawing Sheets

INK SLOTS FOR PROVIDING INK TO UNILATERAL HEATERS

BACKGROUND OF THE INVENTION

1. Field of the Invention

The present invention relates to a thermal inkjet print head and, more particularly, to a thermal inkjet print head chip with at least two ink slots disposed outside two columns of heaters in which each ink slot provides ink to unilateral heaters.

2. Description of the Related Art

Thermal inkjet print heads, successively commercialized on the inkjet printer market, are operated by rapidly heating a small volume of ink, vaporizing the ink, then bubbling and ejected it through nozzle orifice by high pressure. Thus, a dot of ink can be printed onto a recording medium, such as a sheet of paper. Generally, for a one-color inkjet head chip, a single strip of ink slots is used to provide ink to two columns of firing chambers through ink channels, respectively. Also, a thin film heater is disposed inside each firing chamber to cause ink to vaporize and be ejected through one correspondingly positioned nozzle orifice.

FIG. 1A is a top view showing a conventional one-color inkjet head chip. FIG. 1B is a top view partially enlarging the firing chamber and ink slot shown in FIG. 1A. A one-color inkjet head chip 10 comprises two columns of firing chambers 12 in which the firing chambers 12 arranged in one column are not aligned, and a common ink slot 14 disposed between the two columns of firing chambers 12. Also, a plurality of ink channels 18 is provided to the firing chambers 12 respectively for connecting the firing chambers 12 and the ink slot 14. Furthermore, each firing chamber 12 comprises a nozzle orifice and a heater 16 disposed under the nozzle orifice. Therefore, an ink flow 20 moves from the ink slot 14 toward the bilateral firing chambers 12, and then the heater 16 vaporizes the ink to eject an ink dot from the nozzle orifice. Moreover, for providing a power source to the chip 10, a plurality of connecting wires 22 is patterned on the chip 10 to electrically connect the heaters 16 and a plurality of contact pads 24, respectively.

Conventionally, shaping techniques, such as etching, laser working and sandblasting are selected to form the ink slot 14. However, since the lateral space of the ink slot 14 is limited to the two columns of the firing chambers 12, the error tolerance when forming the ink slot 14 is very small, and the lateral size of the ink slot 14 cannot be further increased. This decreases the ink flow amount, speed, supply, and print quality. In addition, the connecting wire 22 is a single metal layer. When the resistance compensation is processed to give each heater 16 an equivalent wiring resistance, the line width of the metal layer is in need of modulation. Nevertheless, depending on the arranged density of the connecting wires 22, the line width of the metal layer is limited.

FIG. 2 is a top view showing a conventional multi-color inkjet head chip. A conventional multi-color inkjet head chip 26 can provide at least three colors of ink from different ink reservoirs. For example, the chip 26 comprises a first inkjet system A, a second inkjet system B and a third inkjet system C. Each of the inkjet systems A, B or C has two columns of firing chambers 12A, 12B or 12C, a common ink slot 14A, 14B and 14C, and a plurality of connecting wires 22A, 22B or 22C for electrically connecting the heaters to the contact pad 24. The firing chambers, ink slots and connecting wires within the inkjet systems A, B and C are similar to the description in FIG. 1B. Since the ink slot 14A provides ink to bilateral firing chambers 12A, the above-described problems in the one-color inkjet head chip 10 are also encountered in the multi-color inkjet head chip 20.

SUMMARY OF THE INVENTION

The present invention is an inkjet print head chip with at least two ink slots outside two columns of firing chambers. Each ink slot provides ink to unilateral heaters in one column of firing chambers.

In one preferred embodiment, An inkjet print head chip comprises: a first column of firing chambers and a second column of firing chambers in which each firing chamber comprises a heater and an ink channel; a first ink slot formed between the first column of firing chambers and the periphery of the chip to provide ink to the heaters in the first column of firing chambers; and a second ink slot formed between the second column of firing chambers and the periphery of the chip to provide ink to the heaters in the second column of firing chambers.

In another preferred embodiment, an inkjet print head chip comprises: a first column of firing chambers and a second column of firing chambers in which each firing chamber comprises a heater and an ink channel; a plurality of first ink sub-slots formed between the first column of firing chambers and the periphery of the chip to provide ink to the heaters in the first column of firing chambers; a plurality of second ink sub-slots formed between the second column of firing chambers and the periphery of the chip to provide ink to the heaters in the second column of firing chambers; and a dry film patterned on the chip to separate the first ink sub-slots and the second ink sub-slots.

In another preferred embodiment, an inkjet print head chip comprises: a first column of firing chambers and a second column of firing chambers in which each firing chamber comprises a heater and an ink channel; a first ink slot formed between the first column of firing chambers and the second column of firing chambers to provide ink to heaters in the first column of firing chambers; a second ink slot formed between the second column of firing chambers and the periphery of the chip, in which the second ink slot comprises a plurality of second ink sub-slots and each second ink sub-slot provides ink to part of heaters in the second column of firing chambers; and a dry film patterned on the entire surface of the chip to separate the second ink sub-slots.

In another embodiment, an inkjet print head chip further comprises: a plurality of connecting wires in which each connecting wire comprises at least two metal layers and an isolating layer; and a plurality of ladder-shaped connecting vias formed between the metal layers and the isolating layer.

The connecting wire goes around the region between the first column of firing chambers and the second column of firing chambers to couple to the periphery of the chip.

Accordingly, it is a principal object of the invention to improve inkflow amount, speed, supply, and print quality.

It is another object of the invention to increase the error tolerance when forming the ink slot.

Yet another object of the invention is to reduce the total area occupied by the connecting wires to compensate for the size of the ink slots.

Also, when the resistance compensation is processed to make each heater 36 have an equivalent wiring resistance, one method is to increase the line width of the metal layer and the other method is to increase the thickness of the metal layer. It is more flexible to adjust the sheet resistance of the connecting wire 42.

It is a further object of the invention to process the resistance compensation by increasing the line width of the metal layer or increasing the thickness of the metal layer.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

[First Embodiment]

Figure 1A:
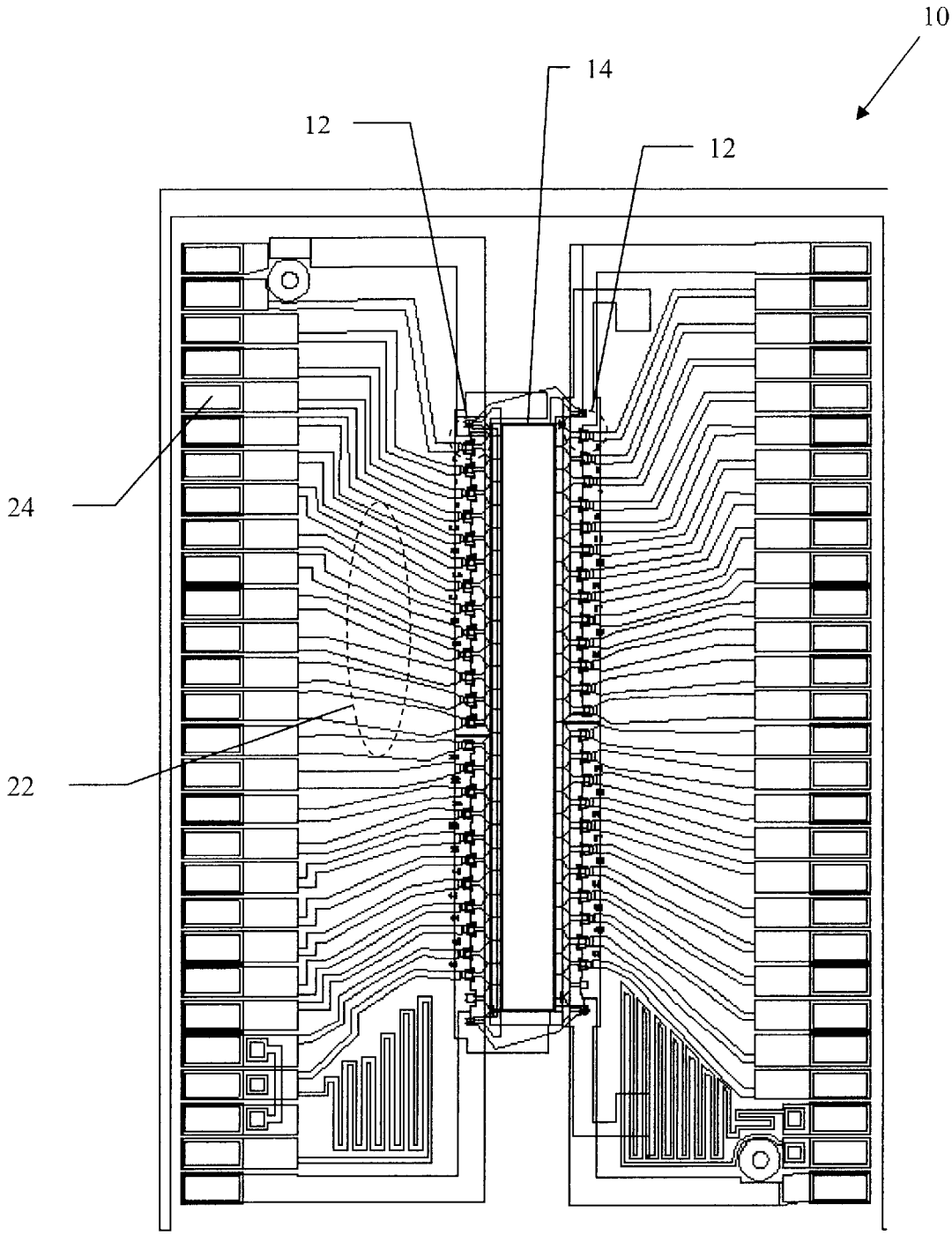
FIG. 1A (PRIOR ART)
FIG. 1A is a top view showing a conventional one-color inkjet head chip.
Figure 1B:
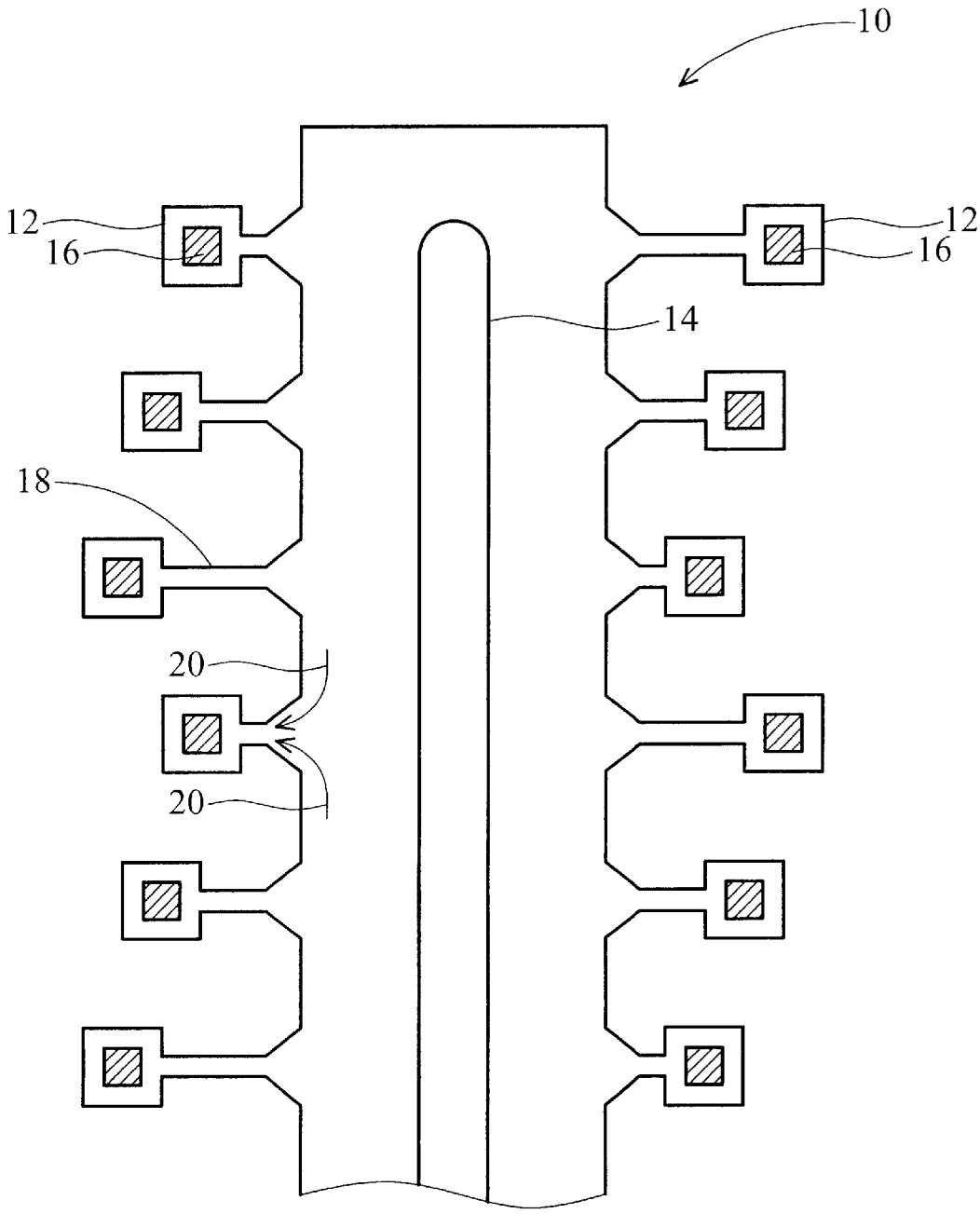
FIG. 1B (PRIOR ART)
FIG. 1B is a top view partially enlarging the firing chamber and ink slot shown in FIG. 1A.
Figure 2:
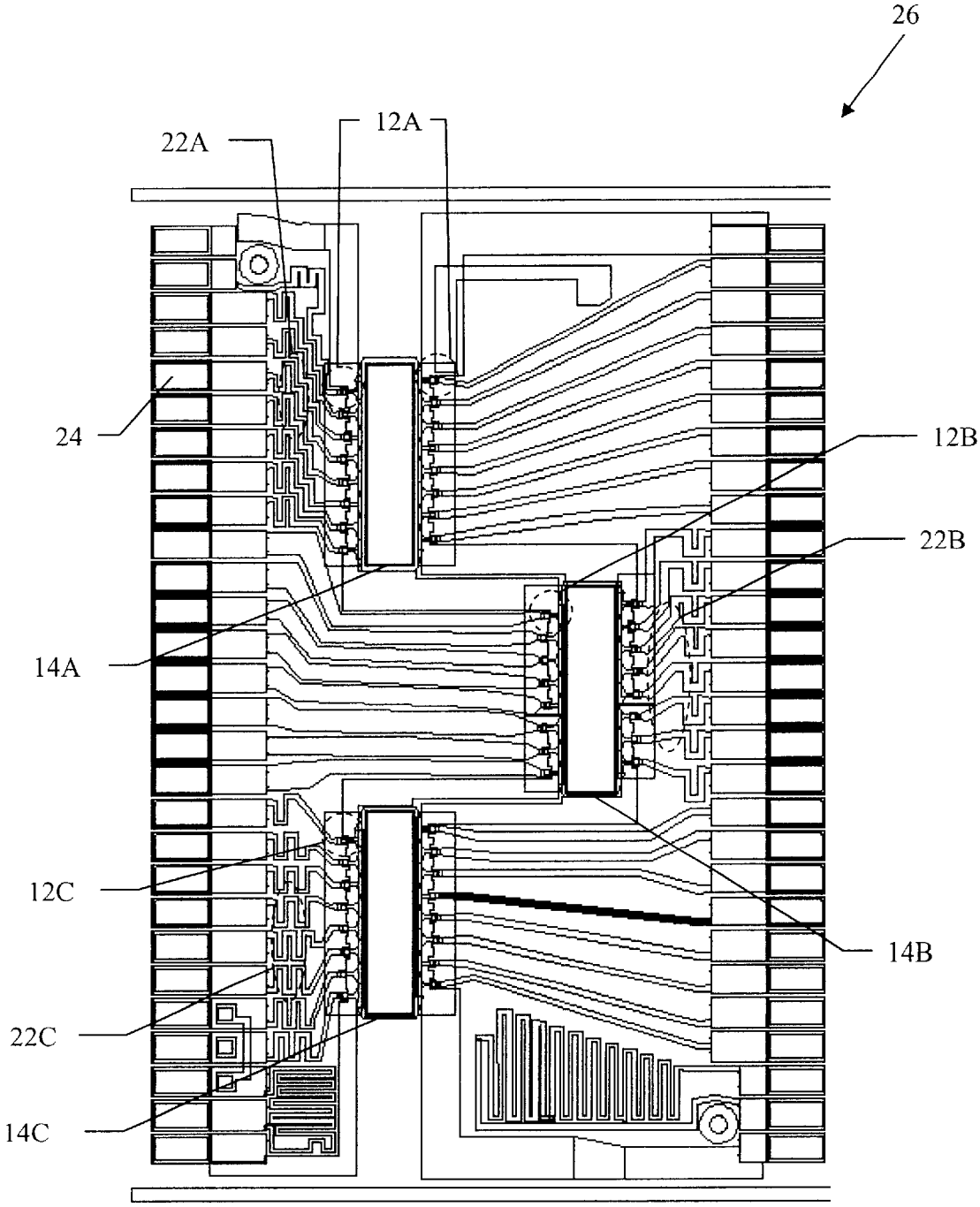
FIG. 2 (PRIOR ART)
FIG. 2 is a top view showing a conventional multi-color inkjet head chip.
Figure 3A:
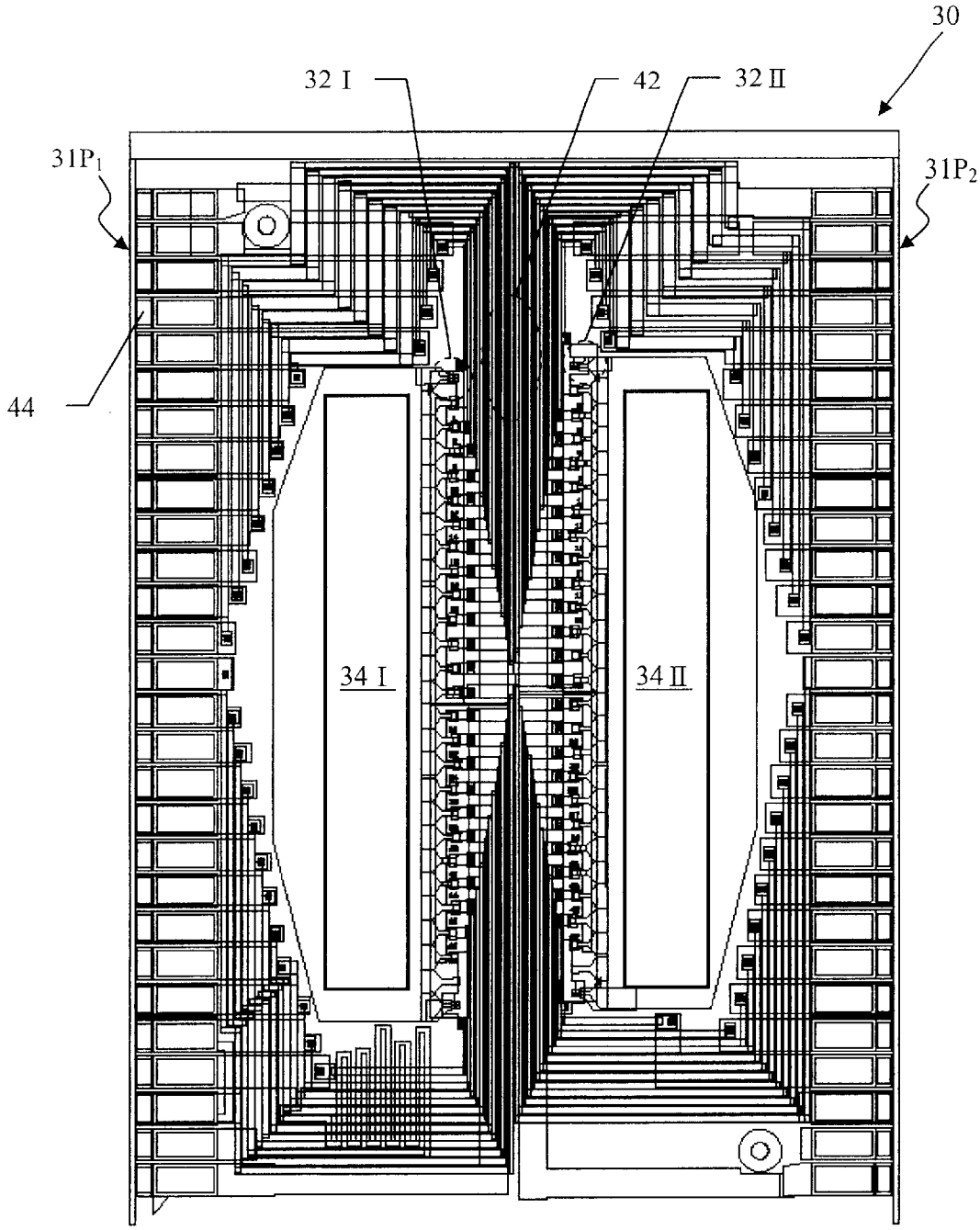
FIG. 3A is a top view showing a one-color inkjet head chip according to the first embodiment of the present invention.
Figure 3B:
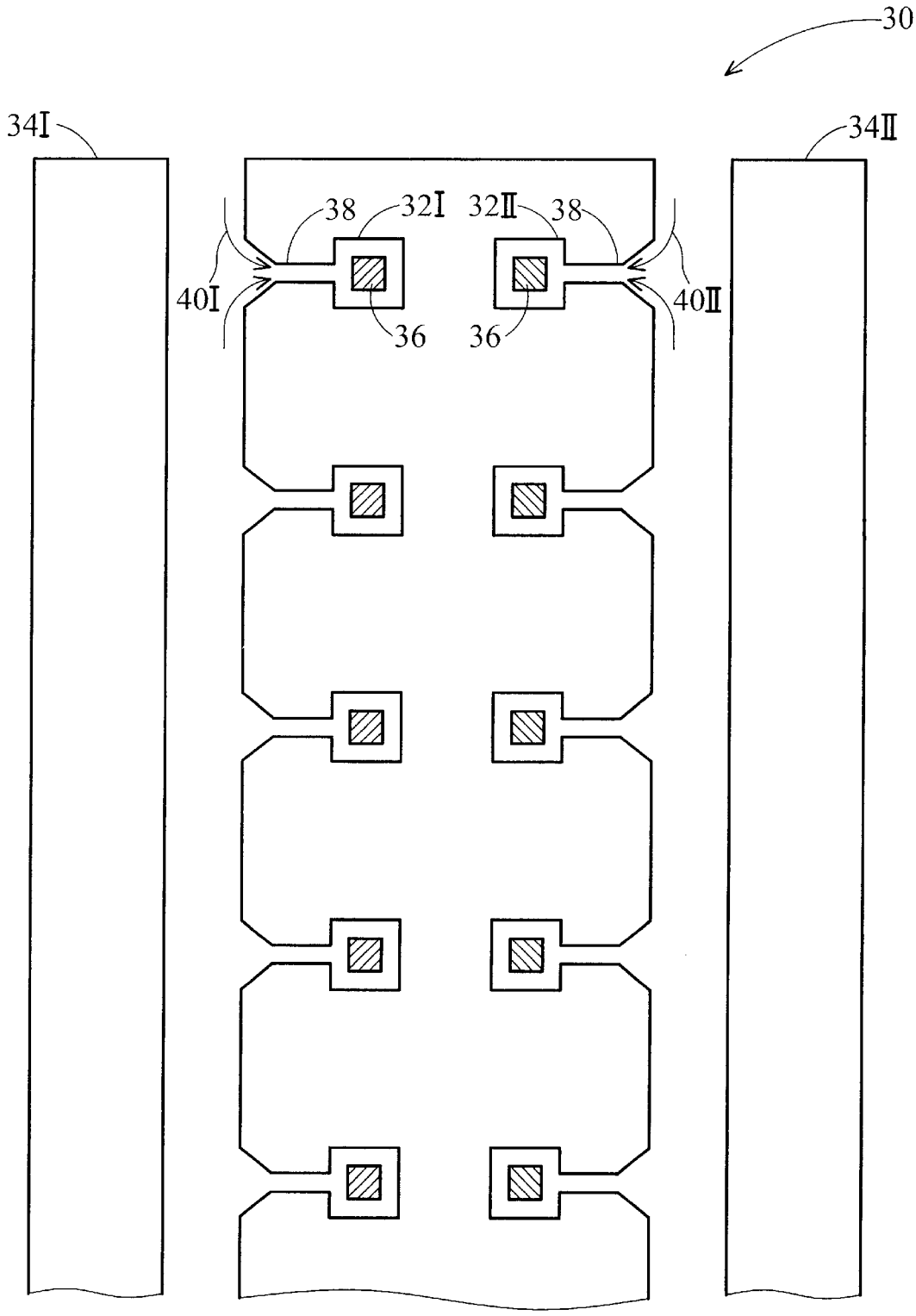
FIG. 3B is a top view partially enlarging the firing chamber and ink slot shown in FIG. 3A.

FIG. 3A is a top view showing a one-color inkjet head chip according to the first embodiment of the present invention. FIG. 3B is a top view partially enlarging the firing chamber and ink slot shown in FIG. 3A.

A one-color inkjet head chip 30 comprises two columns of firing chambers 32I and 32II, in which the transverse distances from the center of the chip 30 to one column of the firing chambers 32 are equal or different. Each firing chamber 32 has an ink channel 38 for connecting an ink slot, a nozzle orifice, and a heater 36 disposed below the nozzle orifice. Also, the chip 30 comprises two parallel strips of ink slots 34I and 34II, in which the first ink slot 34I is disposed between the first column of firing chambers 34I and the a first edge $31P_1$ of the chip 30, and the second ink slot 34II is disposed between the second column of firing chambers 34II and a second edge $31P_2$ of the chip 30. The first edge $31P_1$ is substantially parallel to the first columns of the firing chambers 32I, and the second edge $31P_2$ is substantially parallel to the second columns of firing chambers 32II. Thus, a first ink flow 40I moves in a right direction from the first ink slot 34I toward the first column of firing chambers 32I, and a second ink flow 40II moves in a left direction from the second ink slot 34II toward the second column of firing chambers 32II. According to the variation in the size of the chip 30 and the design of connecting wires, the ink slot 34I and 34II can be modulated as a circular profile, a rectangular profile, a polygon profile or an elliptic profile.

Compared with the common ink slot described in the prior art, the first embodiment of the present invention provides the two ink slots 34I and 34II disposed outside the two columns of the firing chambers 32I and 32II, thus each ink slot 34I or 34II provides ink to unilateral heaters 36. This increases the speed of replenishing ink. Also, only unilateral space of the ink slots 34 is limited to the firing chambers 32, the error tolerance of forming the ink slot 34 is very large, and the lateral size of the ink slot 34 can be further increased. This improves the inkflow amount, speed, supply, and print quality.

The route of the connecting wire 42 goes around the center region between the two columns of the firing chamber 32I and 32II to couple to the a plurality of contact pads 44 of the chip.

Figure 4A:
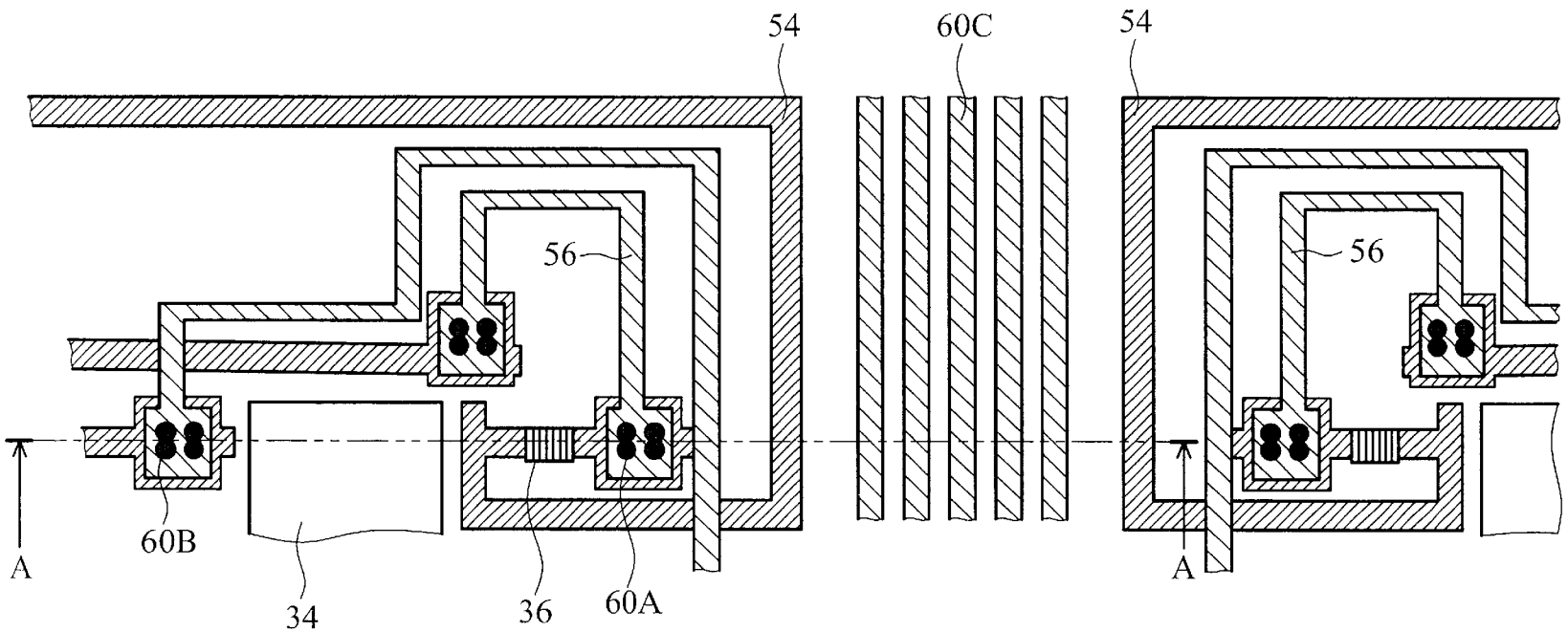
FIG. 4A is a top view partially enlarging the connecting wires shown in FIG. 3A.
Figure 4B:
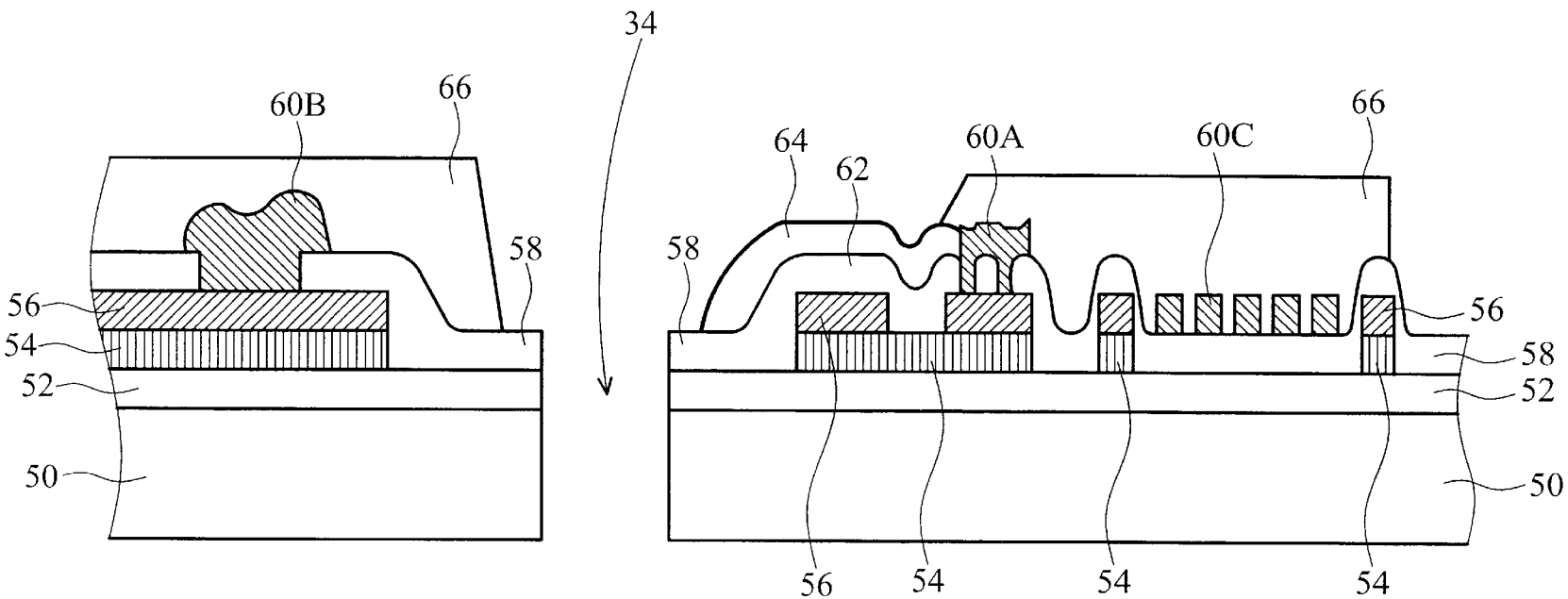
FIG. 4B is a sectional diagram along line A—A shown in FIG. 4A.

FIG. 4A is a top view partially enlarging the connecting wires shown in FIG. 3A. FIG. 4B is a sectional diagram along line A—A shown in FIG. 4A. A silicon wafer 50 has openings on predetermined regions to serve as the above-described ink slots 34. In patterning the above-described connecting wires 42, an insulating layer 52 is formed on the silicon wafer 50, and then a first metal layer 54 is patterned on the insulating layer 52. Next, a second metal layer 56 is patterned on the first metal layer 54, in which the exposed region of the first metal layer 54 serves as a resistance of the above-described heater 36. Next, an isolating layer 58 is patterned on the entire surface of the silicon wafer 50 to expose parts of the second metal layer 56, thus a plurality of connecting vias are formed. Thereafter, a third metal layer 60 is patterned on the isolating layer 58, thus the third metal layer 60 filling the connecting vias serves as contact plugs 60A and 60B, and the third metal layer 60 patterned between the two columns of the firing chambers 32I and 32II serves as the route 60C of the connecting wires 42. Preferably, the insulating layer 52 is $SiO_2$, the second metal layer 54 is TaAl, the second metal layer 56 is AlCu, the isolating layer 58 is SiN/SiC and the third metal layer 60 is Au.

Next, during the formation of the above-mentioned firing chamber 32, an AlCu layer 62 and a Ta layer 64 are deposited and patterned on the entire surface of the silicon wafer 50 to serve as a nozzle plate with nozzle orifices. Finally, a dry film 66 is formed on the entire surface of the silicon wafer 50, and then patterned to expose the ink slots 34. The dry film 66 is used to isolate the first ink slot 34I and the second ink slot 34II to prevent crosstalk between the first column of the firing chambers 32I and the second column of the firing chambers 32II. Also, the dry film 66 is formed to serve as the above-described ink channels 38 to prevent the ink channel 38 collapsing, thus the nozzle plate is supported by the dry film 66 without sinking. This improves inkjet print quality.

Compared with the conventional connecting wire formed by a single metal layer, the present invention employs the laminated structure of the second metal layer 56, the isolating layer 58 and the third metal layer 69 to form the connecting wire 42 with ladder-profile connecting vias. Therefore, the total area occupied by the connecting wires 42 is reduced to compensate for the size of the ink slots 34I and 34II. This enlarges the total size of the ink slots 34I and 34II and the ink channels 38 to further improve the inkjet print quality. Also, when the resistance compensation is processed to give each heater 36 an equivalent wiring resistance, one method is to increase the line width of the metal layer and the other method is to increase the thickness of the metal layer. It is more flexible to adjust the sheet resistance of the connecting wire 42.

[Second Embodiment]

Figure 5A:
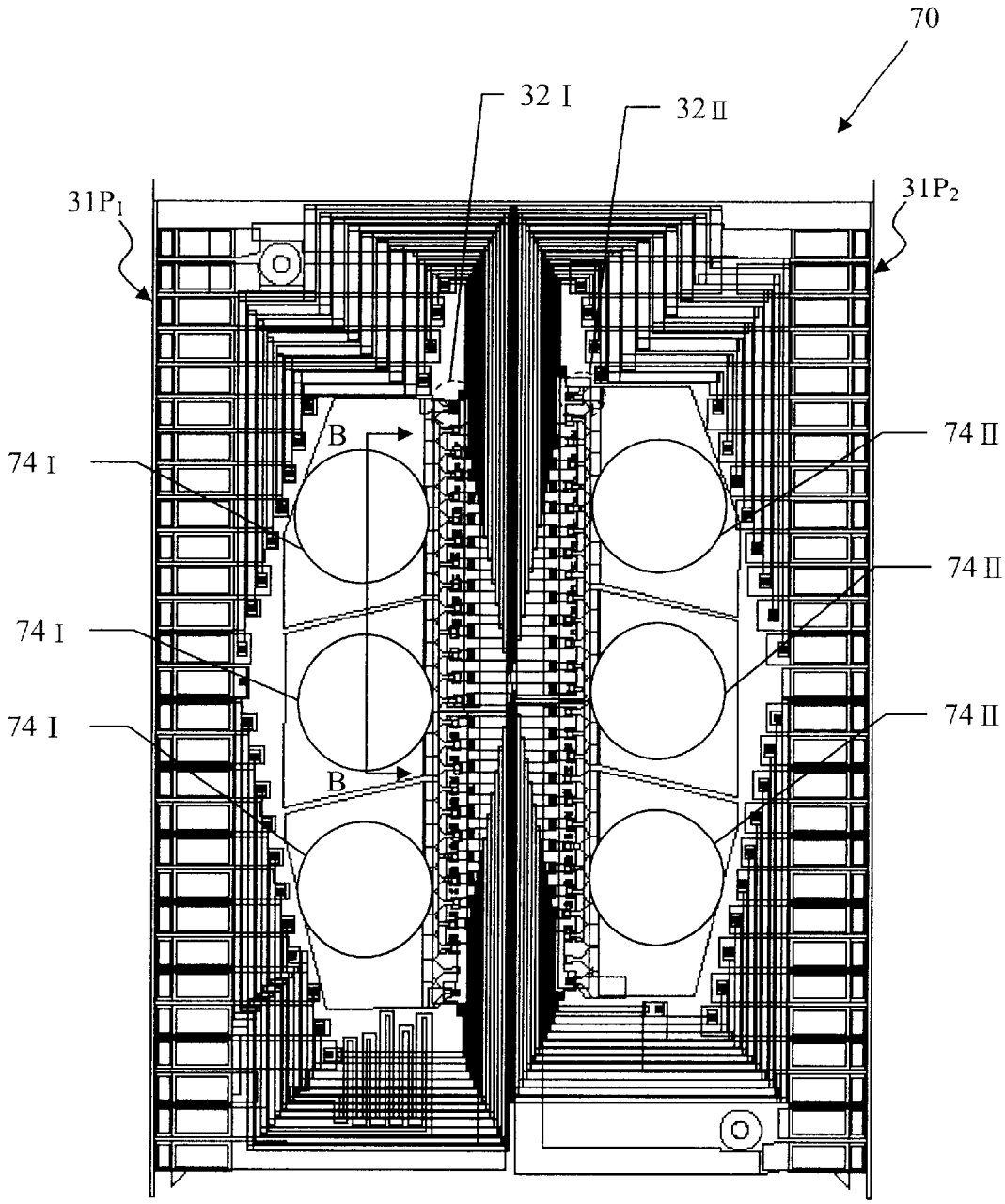
FIG. 5A is a top view showing a one-color inkjet head chip according to the second embodiment of the present invention.
Figure 5B:
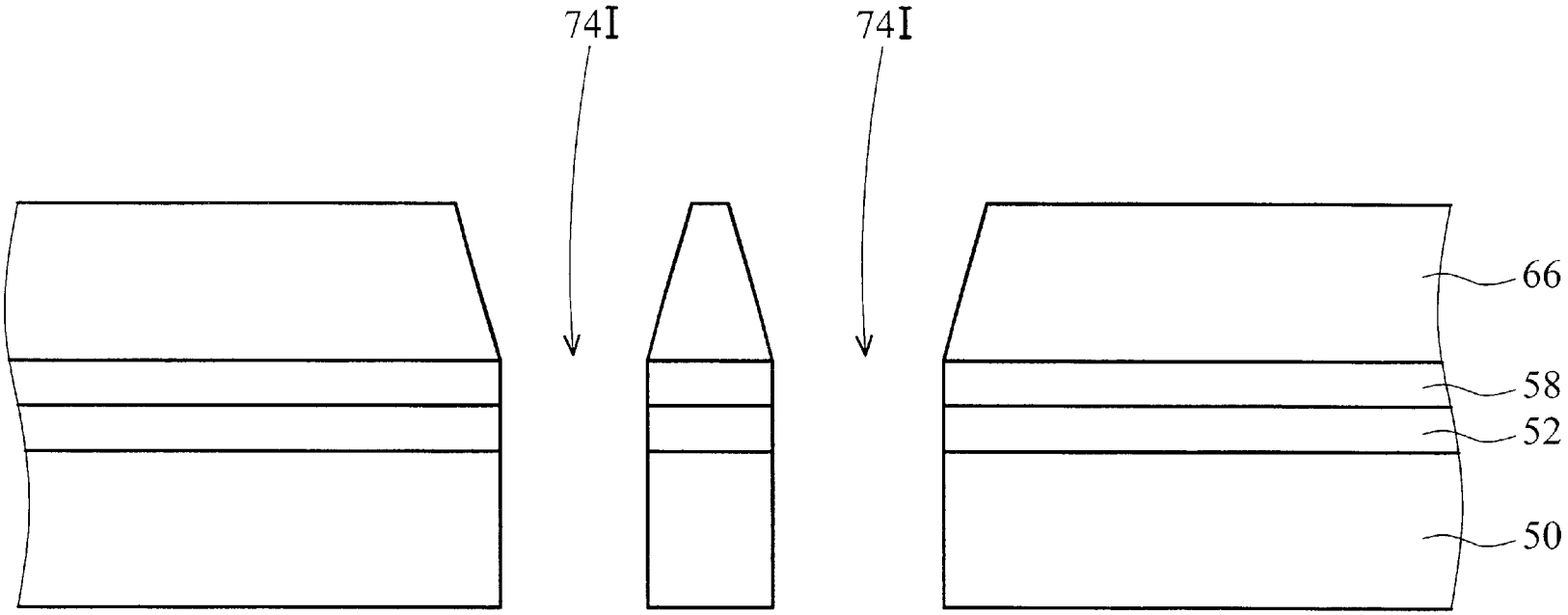
FIG. 5B is a sectional diagram along line B—B shown in FIG. 5A.

FIG. 5A is a top view showing a one-color inkjet head chip according to the second embodiment of the present invention. FIG. 5B is a sectional diagram along line B—B shown in FIG. 5A. A one-color inkjet print head chip 70 changes the above-described strip-shaped ink slot 34 into a plurality of ink sub-slots 74 isolated by the dry film 66. The profile of the ink sub-slot 74 may be of any shape, such as circular, elliptic, rectangular or others. As an example, the first ink slot 34I is changed into three ink sub-slots 74I, in which each ink sub-slot 74I preferably provides ink to seven or eight heaters 36 in the first column of the firing chambers 32I. Similarly, the second ink slot 34II is changed into three ink sub-slots 74II, in which each ink sub-slot 74II preferably provides ink to seven or eight heaters 36 in the second column of the firing chambers 32II.

The design of the connecting wires is similar to the description in the first embodiment to achieve the same structure and advantages.

[Third Embodiment]

Figure 6:
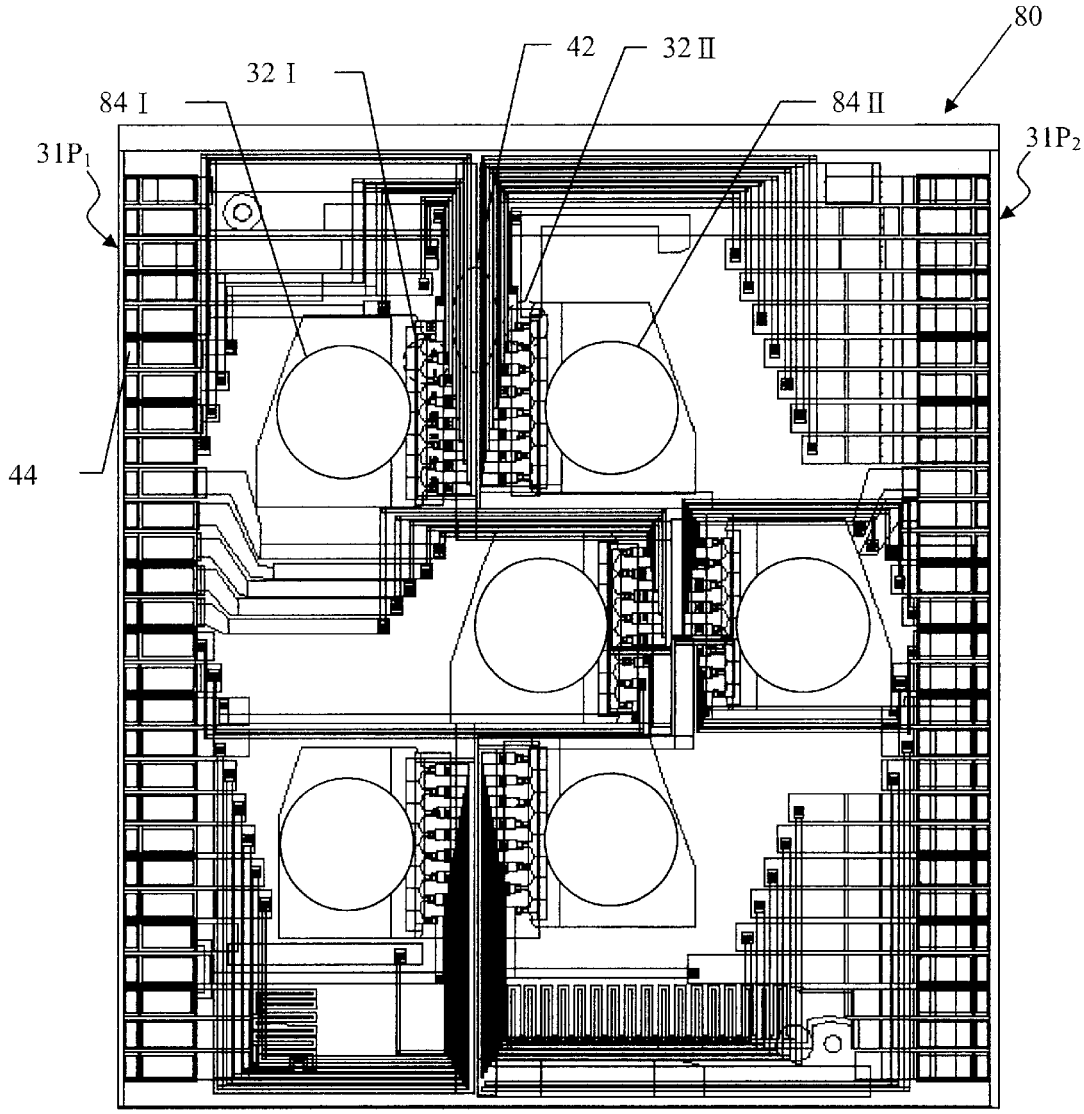
FIG. 6 is a top view showing a multi-color inkjet head chip according to the third embodiment of the present invention.

FIG. 6 is a top view showing a multi-color inkjet head chip according to the third embodiment of the present invention. A multi-color inkjet head chip 80 can provide at least three colors of ink from different ink reservoirs. The chip 80 has a plurality of inkjet systems that are isolated by the dry film 66. For an example, one of the inkjet systems comprises two columns of firing chambers 32I and 32II, two ink slots 84I and 84II, and a plurality of connecting wires 42 for electrically connecting the heaters 36 to the contact pads 44 of the chip 80. In this embodiment, as shown in FIG. 6, the contacts pads are on the edges $31P_1$ and $31P_2$. It is noted that the position of the contact pads are not limited to the edges $31P_1$ and $31P_2$. The contact pads may be designed to be on other edges or suitable position of the chip. The ink slot 84I or 84II has a profile of any shape, such as elliptic, rectangular, circular, or others. Also, the ink slot 84I or 84II provides ink to unilateral firing chambers 32I or 32II. The structures of the firing chamber 32 and the connecting wires 42 are similar to the description in the first embodiment and the second embodiment to achieve the same structure and advantages.

[Fourth Embodiment]

Figure 7:
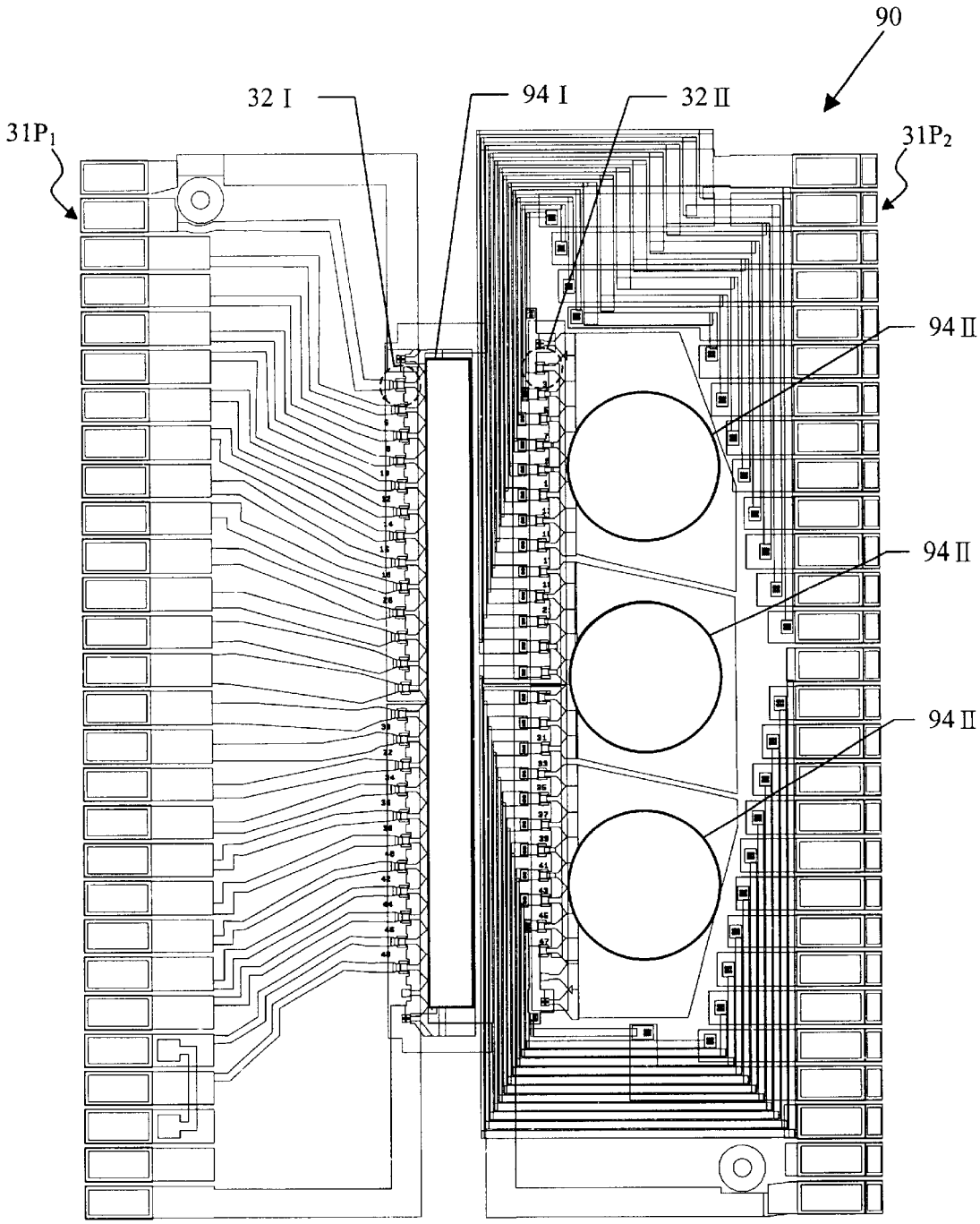
FIG. 7 is a top view showing an inkjet head chip according to the fourth embodiment of the present invention.

FIG. 7 is a top view showing an inkjet head chip according to the fourth embodiment of the present invention. An inkjet head chip 90 comprises a first ink slot 94I disposed between the two columns of firing chambers 32I and 32II, a plurality of second ink slots 94II disposed between the second column of firing chambers 32II and the second edge $31P_2$. of the chip 90. Thus, the first ink slot 94I provides ink to the first column of firing chambers 32I in a left direction, and the second ink slots 94II provides ink to the second column of firing chambers 32II in a left direction. For example, when the chip 90 has three isolated ink slots 94II, each of the second ink slots 94II provides seven or eight heaters 36 in the second column of firing chambers 32II.

Preferably, the profile of the first ink slot 94I or the second ink slot 94II is of any shape, such as elliptic, rectangular, circular, or others. Also, the site of the second ink slots 94II can be exchanged with the region between the first column of firing chambers 32I and the first edge $31P_1$ of the chip 90. Thus, by modifying the opening direction of the ink channel 38, the second ink slots 94II can provide ink to the first column of firing chambers 32I, and the first ink slot 94I can provide ink to the second column of firing chambers 32II.

Depending on the sites of the first ink slot 94I and the second ink slots 94II, the route of the connecting wires is appropriately varied, and the structure of the connecting wires is similar to the description in the first embodiment. In addition, according to the design of the ink reservoirs, the chip 90 can provide one or multiple colors of inkjet print.

It is to be understood that the present invention is not limited to the embodiments described above, but encompasses any and all embodiments within the scope of the following claims.

What is claimed is:

1. An inkjet print head chip, comprising:

a first column of firing chambers and a second column of firing chambers, in which each firing chamber comprises a heater and an ink channel;

a first ink slot formed between the first column of firing chambers and a first edge of the chip to provide ink to the heaters in the first column of firing chambers, in which the first edge is substantially parallel to the first column of firing chambers;

a second ink slot formed between the second column of firing chambers and a second edge of the chip to provide ink to the heaters in the second column of firing chambers, in which the second edge is substantially parallel to the second column of firing chambers;

a dry film patterned on the surface of the chip to separate the first ink slot from the second ink slot;

a plurality of connecting wires in which each connecting wire comprises at least two metal layers and an isolating layer; and a plurality of ladder-shaped connecting vias formed between the metal layers and the isolating layer;

wherein the connecting wire goes around the region between the first column of firing chambers and the second column of firing chambers to couple to a plurality of contact pads of the chip.

2. The inkjet print head chip according to claim 1, wherein the profile of the second ink slot is circular, rectangular, or elliptic.

3. The inkjet print head chip according to claim 1, wherein the first ink slot comprises a plurality of first ink sub-slots in which each first ink sub-slot provides ink to part of heaters in the first column of firing chambers.

4. The inkjet print head chip according to claim 3, wherein the profile of the first ink sub-slot is circular, rectangular, or elliptic.

5. The inkjet print head chip according to claim 3, wherein the dry film separates the first ink sub-slots from each other.

6. The inkjet print head chip according to claim 1, wherein the second ink slot comprises a plurality of second ink sub-slots in which each second ink sub-slot provides ink to part of heaters in the second column of firing chambers.

7. The inkjet print head chip according to claim 6, wherein the profile of the second ink sub-slot is circular, rectangular, or elliptic.

8. The inkjet print head chip according to claim 6, wherein the dry film separates the second ink sub-slots.

9. An inkjet print head chip, comprising a plurality of inkjet systems separated from each other to provide different colors, each inkjet system comprising:

a first column of firing chambers and a second column of firing chambers, in which each firing chamber comprises a heater and an ink channel;

a first ink slot formed between the first column of firing chambers and a first edge of the chip to provide ink to heaters in the first column of firing chambers, in which the first edge is substantially parallel to the first column of firing chambers;

a second ink slot formed between the second column of firing chambers and a second edge of the chip to provide ink to the heaters in the second column of firing chambers, in which the second edge is substantially parallel to the second column of firing chambers;

a plurality of connecting wires in which each connecting wire comprises at least two metal layers and an isolating layer; and a plurality of ladder-shaped connecting vias formed between the metal layers and the isolating layer;

wherein the connecting wire goes around the region between the first column of firing chambers and the second column of firing chambers to couple to a plurality of contact pads of the chip.

10. The inkjet print head chip according to claim 9, wherein the profile of the first ink slot and the second ink slot is rectangular, elliptic or other geometric shape.

11. The inkjet print head chip according to claim 9, further comprising a dry film to separate the plurality of inkjet systems.

12. An inkjet print head chip, comprising:

a first column of firing chambers and a second column of firing chambers, in which each firing chamber comprises a heater and an ink channel;

a first ink slot formed between the first column of firing chambers and a first edge of the chip, in which the first ink slot comprises a plurality of first ink sub-slots and each first ink sub-slot provides ink to part of heaters in the first column of firing chambers, and the first edge is substantially parallel to the first column of firing chambers;

a second ink slot formed between the second column of firing chambers and a second edge of the chip to provide ink to the heaters in the second column of firing chambers, in which the second edge is substantially parallel to the second column of firing chambers; and a dry film patterned on the surface of the chip to separate the first ink sub-slots from each other.

13. The inkjet print head chip according to claim 12, wherein the profile of the first ink sub-slot is circular, rectangular, or elliptic.

14. The inkjet print head chip according to claim 12, wherein the profile of the second ink slot is circular, rectangular, or elliptic.

15. The inkjet print head chip according to claim 12, wherein the second ink slot comprises a plurality of second ink sub-slots in which each second ink sub-slot provides ink to part of heaters in the second column of firing chambers.

16. The inkjet print head chip according to claim 15, wherein the profile of the second ink sub-slot is circular, rectangular, or elliptic.

17. The inkjet print head chip according to claim 12, further comprising:

a plurality of connecting wires in which each connecting wire comprises at least two metal layers and an isolating layer; and a plurality of ladder-shaped connecting vias formed between the metal layers and the isolating layer;

wherein the connecting wire goes around the region between the first column of firing chambers and the second column of firing chambers to couple to a plurality of contact pads of the chip.

18. An inkjet print head chip, comprising:

a first column of firing chambers and a second column of firing chambers, in which each firing chamber comprises a heater and an ink channel;

a first ink slot formed between the first column of firing chambers and the second column of firing chambers to provide ink to heaters in the first column of firing chambers;

a second ink slot formed adjacent to the second column of firing chambers, wherein the second column of firing chambers is disposed between the first ink slot and the second ink slot, and the second ink slot comprises a plurality of second ink sub-slots and each second ink sub-slot provides ink to part of heaters in the second column of firing chambers; and a dry film patterned on the surface of the chip to separate the second ink sub-slots.

19. The inkjet print head chip according to claim 18, wherein the profile of the first ink slot is circular, rectangular, or elliptic.

20. The inkjet print head chip according to claim 18, wherein the profile of the second ink sub-slot is circular, rectangular, or elliptic.

21. The inkjet print head chip according to claim 18, further comprising:

a plurality of connecting wires in which each connecting wire comprises at least two metal layers and an isolating layer; and a plurality of ladder-shaped connecting vias formed between the metal layers and the isolating layer;

wherein the connecting wire goes around the region between the first column of firing chambers and the second column of firing chambers to coupled to the periphery a plurality of contact pads of the chip.

22. The inkjet print head chip according to claim 18, wherein the inkjet print head chip provides one-color ink or multiple-color inks.

* * * * *